US007334851B2

(12) United States Patent
Rose et al.

(10) Patent No.: US 7,334,851 B2
(45) Date of Patent: Feb. 26, 2008

(54) TRANSPARENT TOP FOR A REFRIGERATOR

(75) Inventors: Todd L. Rose, Evansville, IN (US); Patrick S. Streeter, Evansville, IN (US); Alan S. Lucas, Evansville, IN (US); Allan R. Steinkuhl, Evansville, IN (US); Jason R. Yochum, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 209 days.

(21) Appl. No.: 11/122,601

(22) Filed: May 5, 2005

(65) Prior Publication Data

US 2006/0250060 A1 Nov. 9, 2006

(51) Int. Cl.
*A47B 96/00* (2006.01)

(52) U.S. Cl. ..... 312/116; 312/402; 312/405

(58) Field of Classification Search ..... 312/116, 312/122, 138.1, 140, 140.1, 140.3, 265.6, 312/236, 290, 401, 402, 405; 62/258, 446, 62/441, 440; 220/345.5
See application file for complete search history.

(56) References Cited

U.S. PATENT DOCUMENTS 902,934 A * 11/1908 Bourn ..... 312/140.1
1,058,906 A * 4/1913 Schlichting ..... 62/423
1,225,682 A * 5/1917 Schulde ..... 62/255
1,387,486 A * 8/1921 Gray ..... 312/116
1,551,120 A * 8/1925 Sala ..... 312/116
1,760,176 A * 5/1930 Schweller ..... 62/515
1,938,985 A * 12/1933 Starr ..... 62/63
2,164,714 A * 7/1939 Kornblatt ..... 62/258
2,490,494 A 12/1949 Widman
2,554,290 A * 5/1951 Becker ..... 62/329
2,613,844 A * 10/1952 Mounce ..... 220/345.6
2,618,936 A 11/1952 Kennedy
2,669,851 A 2/1954 Pichler
2,711,944 A 6/1955 Meek et al.
2,786,337 A * 3/1957 Spring ..... 62/258
2,800,774 A * 7/1957 Kondos ..... 62/255
2,836,968 A * 6/1958 Ferris ..... 62/258
2,893,805 A 7/1959 Ferguson
2,961,851 A * 11/1960 Ehrenfreund ..... 62/448
2,967,404 A 1/1961 Detwiler
4,274,267 A 6/1981 James et al. ..... 62/252
D267,323 S 12/1982 Ogiwara ..... D15/83
4,396,237 A * 8/1983 Henry ..... 312/42
4,449,761 A 5/1984 Davis et al. ..... 312/116
4,658,553 A 4/1987 Shinagawa ..... 52/172
4,759,193 A 7/1988 Dehring ..... 62/258
4,896,785 A 1/1990 Sodervall ..... 220/82

(Continued)

*Primary Examiner*—Janet M. Wilkens
(74) *Attorney, Agent, or Firm*—Michael D. Lafrenz; Kirk Goodwin

(57) ABSTRACT

A refrigeration appliance with a cabinet having a front wall, a rear wall, side walls and a top enclosing a refrigerated space. A front panel in the front wall is openable to provide access to the refrigerated space. The cabinet walls are sized to fit below a standard countertop height in a domestic kitchen. The top for the cabinet, which is arranged to be sealingly engaged with the cabinet, has at least a portion thereof which is transparent to allow a user to view at least a portion of the refrigerated space without opening the panel. In an embodiment, a removable cover may be provided which is sized to overlie the cabinet top.

18 Claims, 2 Drawing Sheets

U.S. PATENT DOCUMENTS

| | | | | |
|---|---|---|---|---|
| 4,930,321 | A * | 6/1990 | Takahashi | 62/249 |
| 4,941,327 | A | 7/1990 | Miles | 62/246 |
| 5,083,444 | A * | 1/1992 | Eming | 62/440 |
| 5,117,777 | A * | 6/1992 | Takasugi | 119/203 |
| 5,120,118 | A | 6/1992 | Rankin | 312/409 |
| D337,699 | S | 7/1993 | Espersen | D7/605 |
| 5,428,968 | A * | 7/1995 | Tetsukawa et al. | 62/248 |
| D396,048 | S | 7/1998 | Meehan | D15/83 |
| D432,550 | S | 10/2000 | Jobst | D15/83 |
| 6,202,432 | B1 * | 3/2001 | Haasis | 62/258 |
| 6,502,570 | B2 * | 1/2003 | Grady | 126/37 A |
| D470,866 | S | 2/2003 | Beauregard | D15/83 |
| 6,776,000 | B2 * | 8/2004 | Kim et al. | 62/258 |
| 7,040,114 | B2 * | 5/2006 | Lee et al. | 62/443 |
| 2003/0205256 | A1 | 11/2003 | DeBoer et al. | |
| 2006/0288723 | A1 * | 12/2006 | Hand | 62/258 |

* cited by examiner

TRANSPARENT TOP FOR A REFRIGERATOR

BACKGROUND OF THE INVENTION

Refrigerator appliances are known that are arranged to fit below a counter level, such as disclosed in U.S. Pat. Nos. 2,711,944, 2,618,936 and 2,490,494. In such arrangements, the refrigeration compartment is accessed through doors or drawers positioned below the countertop level. The top of the appliance is opaque or positioned below an opaque countertop, requiring a user to open the interior of the refrigeration appliance to view the contents and perhaps even to bend over to be able to see the contents. This action increases the energy usage of the appliance in that each time the interior is opened, the heat load on the appliance is increased.

It is also known to provide a glass top for below the counter refrigeration appliances to allow a user to view at least part of the contents of the refrigeration compartment. Typically such refrigeration appliances are for the storage of frozen products, such as ice cream, or beverages, such as carbonated beverages. Examples of such refrigeration appliances are shown in U.S. Pat. Nos. 4,274,267 and 4,449,761. These refrigeration appliances allow for accessing the interior of the appliance only through the top and not through a front of the cabinet. A drawback of glass top refrigerator appliances is that they leak a great deal of heat through the glass and around any openings or seals if the glass is not permanently secured to the appliance cabinet, and therefore are not energy efficient.

It therefore would be an improvement in the art if there were provided a refrigeration appliance that had a refrigeration compartment accessible from a front of the appliance, and also had a top that was at least partially transparent to permit a user to view at least a portion of the refrigeration appliance without opening the refrigeration compartment. It would also be an improvement if a cover were provided for a transparent top refrigeration appliance to reduce energy loss during times when the interior of the refrigeration appliance is not being viewed from the exterior.

SUMMARY OF THE INVENTION

The present invention provides an improved refrigeration appliance with a cabinet having a front wall, a rear wall, side walls and a top enclosing a refrigerated space. A front panel in the front wall is openable to provide access to the refrigerated space. The cabinet walls are sized to fit below a standard countertop height in a domestic kitchen. The top for the cabinet, which is arranged to be sealingly engaged with the cabinet, has at least a portion thereof which is transparent to allow a user to view at least a portion of the refrigerated space without opening the panel.

In an embodiment of the invention, the panel comprises a hinged door.

In an embodiment of the invention, the panel comprises a front to a sliding drawer.

In an embodiment of the invention, the top is positioned at the standard countertop height.

In an embodiment of the invention, the top is configured and arranged to rest upon or abut against a countertop adjacent to the cabinet.

In an embodiment of the invention, a gasket is added to an outer perimeter of the top to serve as a seal between the top and the countertop or an adjacent cabinet.

In an embodiment of the invention, the top comprises a multi-ply pane assembly.

In an embodiment of the invention, the multi-ply pane assembly comprises a top pane having sufficient strength to withstand load requirements associated with a domestic countertop.

In an embodiment of the invention, the multi-ply pane assembly comprises a plastic ring surrounding and supporting a plurality of panes.

In an embodiment of the invention, the panes are permanently affixed by bonding to the plastic ring with an adhesive.

In an embodiment of the invention, the plastic ring is hollow and is filled with foam.

In an embodiment of the invention, the multi-ply pane assembly comprises a plurality of panes separated from one another, with a space in between the panes being filled with an inert gas.

In an embodiment of the invention, the multi-ply pane assembly comprises three parallel panes each spaced apart from one another.

In an embodiment of the invention, an illumination means is positioned within the refrigerated space and operatively energizable to selectively illuminate the interior of the refrigerated space.

In an embodiment of the invention, the multi-ply pane assembly is pivotally attached to the cabinet such that the assembly can be pivoted to an open position to allow access to the refrigerated space.

In an embodiment of the invention, at least one of the panes is provided with a graphics pattern thereon to render at least a portion of an interface between the cabinet and the multi-ply pane assembly not visible to a user.

In an embodiment of the invention, a removable cover is sized to overlie the cabinet top.

In an embodiment of the invention, the cover provides an increased insulation value for the top.

In an embodiment of the invention, the top comprises at least one glass pane, and a removable insulated cover is sized to overlie said glass pane.

In an embodiment of the invention, the cover comprises an insulation layer and a useful layer, such as a cutting board.

In an embodiment of the invention, the cover comprises a foam insulation seal between the cover and the glass pane.

DETAILED DESCRIPTION OF THE PREFERRED EMBODIMENT

The present invention is directed to a refrigeration appliance having a top that is at least partially transparent to permit viewing of the interior refrigerated space without opening an access panel which would allow refrigerated air to leave the space and would allow warmer air to enter the space. With such an appliance, a user may check the contents of the refrigeration appliance before opening an access panel, thereby reducing the amount of time that the panel is opened, hence reducing energy usage and cost of operating the appliance. The invention can be practiced in a wide variety of different embodiments, as will be apparent to a person skilled in the refrigeration art, and the following description is meant to illustrate one possible embodiment of the invention without limiting the scope of the claims appended hereto.

Figure 1:
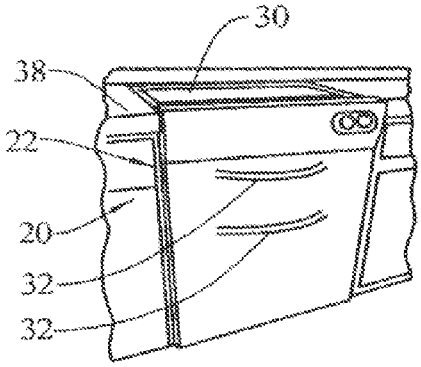
FIG. 1 illustrates a perspective view of a refrigeration appliance incorporating a transparent top embodying the principles of the present invention.
Figure 2:
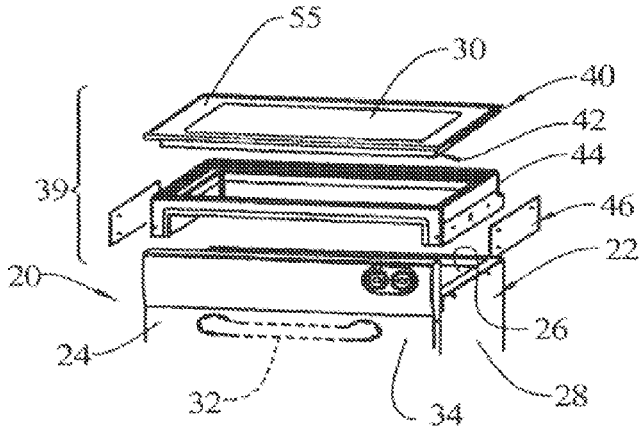
FIG. 2 illustrates a partial, perspective exploded view of a top assembly for the refrigeration appliance of FIG. 1.
Figure 3:
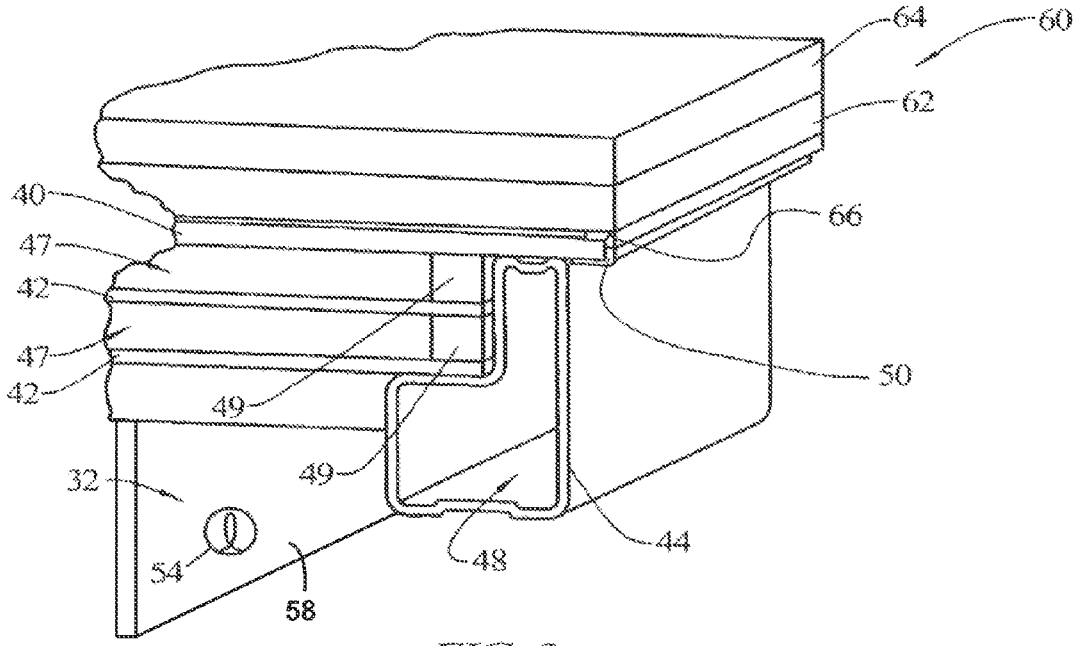
FIG. 3 illustrates a partial perspective sectional view of the top assembly for the refrigeration appliance of FIG. 1.
Figure 5:
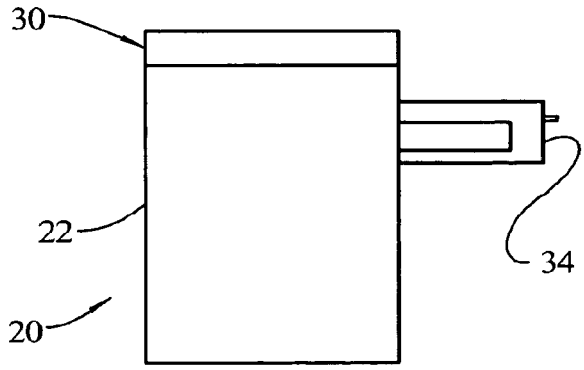
FIG. 5 illustrates a schematic side elevational view of the refrigeration appliance with a slidably openable drawer.
Figure 6:
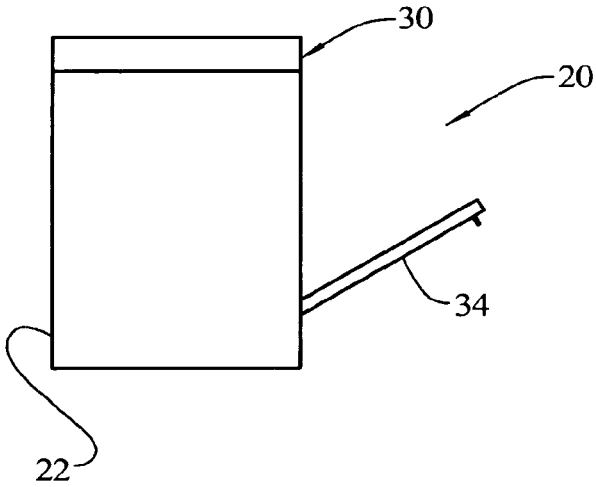
FIG. 6 illustrates a schematic side elevational view of the refrigeration appliance with a pivotally door.

In the illustrated embodiment shown in FIGS. 1-3, a refrigeration appliance 20 is shown which includes a cabinet 22 having a front wall 24, a rear wall 26, side walls 28 and a top 30 enclosing a refrigerated space 32. One or more front panels 34 in the front wall 24 may be openable to provide access to the refrigerated space 32. For example the panel 34 may be a hinged door so that the interior refrigerated space 32 may be accessed by pivotally opening the door (FIG. 6). Alternatively, the panel 34 may be a front to a sliding drawer so that the interior refrigerated space 32 may be accessed by pulling open the drawer (FIG. 5). Further, the panel 34 may be a sliding door so that the interior refrigerated space 32 may be accessed by sliding the panel.

The cabinet walls 24, 26, 28 are sized to fit below a standard countertop height in a domestic kitchen. Typically such a height ranges between 24 and 36 inches and commonly is about 30 inches.

The top 30 for the cabinet 22, is arranged to be sealingly engaged with the cabinet, as described below, having at least a portion thereof which is transparent to allow a user to view at least a portion of the refrigerated space 32 without opening the panel 34 or the top 30 if it is openable. The 30 top may be positioned at the standard countertop height, or the top may be configured and arranged to rest upon a countertop 38 adjacent to the cabinet 22.

The top 30 may be an assembly of parts comprising a multi-ply pane assembly 39 including a top pane 40 of an at least partially transparent material such as glass, polycarbonate or other high strength plastic, one or more secondary panes 42 of an at least partially transparent material such as glass or plastic, a support ring 44 surrounding and supporting the plurality of panes, and mounting brackets 46 to secure the support ring to two or more of the cabinet walls 24, 26, 28.

The top pane 40 is provided with sufficient strength to withstand load requirements associated with a domestic countertop. For example, the top pane 40 may be made of a strengthened or tempered glass material and may be provided with an increased thickness as compared to the secondary panes 42. The multi-ply pane assembly 39 comprises the plurality of panes 40, 42 separated from one another, with a space 47 in between each of the panes being filled with an inert gas to enhance a thermal insulative quality of the multi-ply pane assembly. In FIG. 3, the multi-ply pane assembly 39 is illustrated as being formed with three parallel panes 40, 42 each spaced apart from one another. The panes 40, 42, whether glass or plastic, may be separated from one another by a space filled with another gas, such as air, or by a solid such as a transparent plastic material that has insulative properties. If a plurality of panes 40, 42 are provided, they may be of more than one material and they may either be spaced apart or abutting one another.

The support ring 44 may be formed of a plastic material allowing the panes 40, 42 to be permanently affixed by bonding to the plastic ring with an adhesive. The support ring may also be formed with a hollow interior 48 so that the plastic ring may be filled with insulating foam.

A gasket 50 may be added to an outer perimeter 52 of the top pane 40 to serve as a seal between the top pane 40 and the countertop 38, particularly where the top pane rests on the countertop. The gasket 50 may be configured to serve as a seal between the assembly 39 and an adjacent cabinet with a vertical seal surface. The seal may be in the form of the gasket 50 as illustrated, or may be an inflatable seal that is placed in the gap between the assembly 39 and the countertop 38 or cabinet and subsequently inflated. The seal may also comprise a foam in place seal or a silicone sealant applied at the time the refrigerator is installed.

Figure 4:
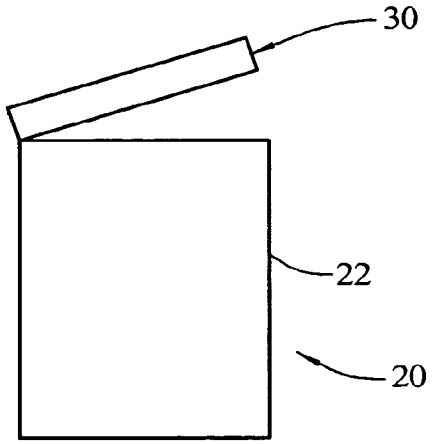
FIG. 4 illustrates a schematic side elevational view of the refrigeration appliance with a pivotally openable top.

In an embodiment, the multi-ply pane assembly 39 may be pivotally attached to the cabinet 20 such that the assembly can be pivoted to an open position to allow access to the refrigerated space 32 (FIG. 4). In such an embodiment, access through the pivotable top 30 may be the only access provided for the refrigerated space 32, or such access may be in conjunction with one or more panels 34 on the front wall 28. In another embodiment, the multi-ply pane assembly 39 may be permanently affixed to the cabinet 20 so that access to the refrigerated space 32 may be accomplished only through the movable panel 34.

The refrigerated space 32 may be provided with an illumination device 54 operatively energizable to selectively illuminate the refrigerated space. Such an illumination device 54 may be one or more incandescent bulbs or other well known types of light emitting devices positioned either within the refrigerated space 32 or being positioned outside of the refrigerated space and having the light output of the device directed into the refrigerated space.

If multiple refrigeration compartments are vertically arranged in the refrigerated space 32, dividers 58 (FIG. 3) separating the various compartments may be formed of a transparent or partially transparent material to allow visibility into more than one compartment, or the dividers may be opaque or translucent, preventing visibility beyond an uppermost compartment.

In an embodiment, at least one of the panes 40, 42 may be provided with a graphics pattern 55 thereon to render at least a portion of an interface between the cabinet 22 and the multi-ply pane assembly 39 not visible to a user. For example, a paint or other coating material may be applied to a top or bottom surface of one or more of the panes 40, 42, around a perimeter of the pane such that only a central portion of the pane is transparent. The user will still be able to fully view the interior of the refrigerated space 32, however, the connection between the support ring 44 and the cabinet walls 24, 26, 28 will not be visible. Other components, including wiring, fasteners, gaskets, and similar elements may be hidden from view in this manner as well. Such a graphics pattern may also provide a cosmetic enhancement to the appearance of the appliance and may contain various information including model and brand identifiers.

In order to enhance the insulative properties of the top 30 of the refrigeration appliance 20, particularly when the user is not concerned with viewing the refrigerated space 32, as well as to provide additional features for the appliance, a movable cover 60 may be provided which is sized to overlie the appliance 20 or the cabinet top as shown in FIG. 3. The movable cover 60 may be completely removable from the appliance 20, or may be movable to allow for viewing through the top 30, such as by pivoting to an open position. In an embodiment, the cover 60 may be formed of a material which provides an increased insulation value for the top 30.

For example, the cover 60 may have an insulation layer 62 and a cutting board layer 64. The insulation layer 62 may be in the form of a foam insulation. Further, a foam insulation seal 66 may be provided on the cover 60 sized to engage the top pane 40. The foam insulation seal 66 may be configured to overlie a perimeter of the top pane 40 so that the cover 60 will be restrained against moving horizontally relative to the top pane. The cutting board layer 64 provides an additional feature for the refrigeration appliance 20 in the form of an additional work surface at countertop height for the user. The cutting board layer 64 may be formed of wood, plastic or other well known cutting board materials. The top layer of the cover may alternately be formed of materials other than those used as cutting boards, such as countertop materials, including wood, plastic, ceramic tile, synthetic countertop materials, and natural stone countertop materials.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A refrigeration appliance comprising:

a cabinet having a front wall, a rear wall, side walls and a top enclosing a refrigerated space, a panel in one of said walls and top being openable to provide access to said refrigerated space, said top having at least a portion thereof which is transparent to allow a user to view at least a portion of said refrigerated space without opening said panel, and a movable cover sized to overlie a substantial portion of said top, wherein said cover is configured to overlie a portion of a countertop adjacent to said cabinet.

2. A refrigeration appliance according to claim 1, wherein said top is pivotally attached to said cabinet such that said top can be pivoted to an open position to allow access to said refrigerated space.

3. A refrigeration appliance according to claim 1, wherein said cover provides an increased insulation value for said top.

4. A refrigeration appliance according to claim 3, wherein said cover comprises an insulation layer and a cutting board layer.

5. A refrigeration appliance according to claim 3, wherein said cover comprises a foam insulation seal between said cover and said pane.

6. A refrigeration appliance comprising:

a cabinet having a front wall, a rear wall, side walls and a top enclosing a refrigerated space, at least one divider panel to separate compartments within the refrigerated space, and a front panel in said front wall being openable to provide access to said refrigerated space, said cabinet walls sized to fit below a countertop height, said top having at least a portion thereof which is transparent to allow a user to view at least a portion of said refrigerated space without opening said panel, and said top is configured to overlie a portion of a countertop adjacent to said cabinet, and said at least one divider panel having at least a portion thereof which is transparent to allow a user to view contents of the compartments.

7. A refrigeration appliance according to claim 6, wherein said panel comprises a hinged door.

8. A refrigeration appliance according to claim 6, wherein said panel comprises a front to a sliding drawer.

9. A refrigeration appliance according to claim 6, wherein said top is positioned at a countertop height.

10. A refrigeration appliance according to claim 6, further including a gasket added to an outer perimeter of said top to serve as a seal between said top and said countertop.

11. A refrigeration appliance according to claim 6, wherein said top comprises a multi-ply pane assembly.

12. A refrigeration appliance according to claim 11, wherein said multi-ply pane assembly comprises a top pane having sufficient strength to withstand load requirements associated with a domestic countertop.

13. A refrigeration appliance according to claim 11, wherein said multi-ply pane assembly comprises a plastic ring surrounding and supporting a plurality of panes.

14. A refrigeration appliance according to claim 13, wherein at least one of said panes is provided with a graphics pattern thereon to render at least a portion of an interface between said cabinet and said multi-ply pane assembly not visible to a user.

15. A refrigeration appliance according to claim 11, wherein said multi-ply pane assembly comprises three parallel panes.

16. A refrigeration appliance according to claim 6, including an illumination device positioned within said refrigerated space and operatively energizable to selectively illuminate said refrigerated space.

17. A refrigeration appliance according to claim 6, further including a movable cover sized to overlie said cabinet top.

18. A refrigeration appliance according to claim 6, wherein said top comprises at least one glass pane, and further including a movable insulated cover sized to overlie said glass pane.

* * * * *